US005735717A

United States Patent [19]

Nabeshima

[11] Patent Number: 5,735,717

[45] **Date of Patent: *Apr. 7, 1998**

[54] FEMALE TERMINAL METAL FIXTURE

[75] Inventor: Akira Nabeshima, Yokkaichi, Japan

[73] Assignee: Sumitomo Wiring Systems, Ltd., Japan

[ * ] Notice: The term of this patent shall not extend beyond the expiration date of Pat. No. 5,593,328.

[21] Appl. No.: 833,810

[22] Filed: Apr. 9, 1997

Related U.S. Application Data

[63] Continuation of Ser. No. 499,948, Jul. 10, 1995, abandoned.

[30] Foreign Application Priority Data

Jul. 11, 1994 [JP] Japan ..... 6-182869

[51] Int. Cl.[6] ..... H01R 11/22

[52] U.S. Cl. ..... 439/851

[58] Field of Search ..... 439/850, 851, 439/852, 853, 839, 842, 843, 845

[56] References Cited

U.S. PATENT DOCUMENTS

| | | | |
|---|---|---|---|
| 4,473,269 | 9/1984 | Bettary | 439/839 |
| 4,699,444 | 10/1987 | Isobata . | |
| 4,927,788 | 5/1990 | Nakashima et al. . | |
| 5,350,321 | 9/1994 | Takenouchi | 439/851 |
| 5,427,552 | 6/1995 | Zielinski et al. | 439/850 |
| 5,443,592 | 8/1995 | Ittah et al. | 439/851 |
| 5,480,320 | 1/1996 | Saimoto | 439/852 |
| 5,540,603 | 7/1996 | Fujiwara | 439/851 |
| 5,593,328 | 1/1997 | Okada et al. | 439/851 |

FOREIGN PATENT DOCUMENTS

| | | |
|---|---|---|
| 60-99783 | 7/1985 | Japan . |
| 62-137575 | 8/1987 | Japan . |
| 63-26979 | 2/1988 | Japan . |
| 2-117672 | 9/1990 | Japan . |

*Primary Examiner*—Gary F. Paumen
*Assistant Examiner*—Tho D. Ta
*Attorney, Agent, or Firm*—Jordan B. Bierman; Bierman, Muserlian and Lucas

[57] ABSTRACT

A female terminal metal fixture (2) in which an elastic tongue is prevented from being extremely deflected. A portion between a turned-back portion (**25*b*) and a top portion (25*a*) on an elastic tongue (25) is strengthened by a reinforcing portion (26). When a tab (4) is improperly inserted into the fixture (2), the top portion (25*a*) and turned-back portion (25*b*) on the elastic tongue (25) are supported on stoppers (27) and an auxiliary stopper (29), respectively. Thus, even if the tab pushes down strongly a portion between the turned-back portion (25*b*) and the top portion (25*a***), the elastic tongue is not deflected over an elastic limit.

6 Claims, 14 Drawing Sheets

FEMALE TERMINAL METAL FIXTURE

This application is a continuation, of application Ser. No. 08/499,948, filed Jul. 10, 1995, now abandoned.

BACKGROUND OF THE INVENTION (1) Field of the invention

This invention relates to a female terminal metal fixture which has an elastic tongue resiliently contacting with a tab of a male terminal metal fixture and functions of prevent excess deflection of the tongue.

(2) Statement of the Prior Art

In a conventional female terminal metal fixture provided with an elastic tongue which resiliently contacts with a tab of a male terminal metal fixture, means for preventing excess deflection of the elastic tongue over an elastic limit will be described below by referring to FIGS. 14 to 16, for convenience of explanation.

FIG. 14 is a longitudinal sectional view of a conventional female terminal metal fixture, illustrating a position in which a tab of a male terminal metal fixture commences to enter into the female terminal metal fixture. FIG. 15 is a longitudinal sectional view of a conventional female terminal metal fixture, illustrating a position in which the tab is properly inserted into the female terminal metal fixture. FIG. 16 is a longitudinal sectional view of a conventional female terminal metal fixture, illustrating a position in which the tab is improperly inserted into the female terminal metal fixture, thereby causing excess deflection of an elastic tongue.

FIG. 14 shows a conventional female terminal metal fixture 1 wherein a stopper 13 is formed along each longitudinal side edge of a fitting aperture 12 by upwardly bending the bottom wall. The fitting aperture 12 receives a lance provided in a cavity in a connector. The stoppers 13 are disposed at a rear side of a top area of an elastic tongue 17 which is formed into a gently bent body.

Upon inserting a tab 15 of a male terminal metal fixture (not shown) through a front opening into an insertion space 14 in the female terminal metal fixture, if an insertion angle of the tab 15 is proper, the tab 15 moves along a ceiling wall 16 in the insertion space 14 and reaches the top area of the elastic tongue 17, as shown in FIG. 15. At this time, the elastic tongue 17 is not sufficiently deflected to contact with the stoppers 13.

If the insertion angle of the tab 15 is directed downwardly, however, the elastic tongue 17 is deflected down more than the deflection shown in FIG. 15 and contacts with the stoppers 13 within the elastic limit of the tongue 17, thereby preventing the tongue 17 from being brought into plastic deformation.

In the case that the insertion angle of the tab 15 is great relative to a horizontal direction, the tab 15 abuts on an intermediate portion between a turned-back portion 17*a* of the elastic tongue 17 and a contact area 17*b* with the stoppers 13, as shown in FIG. 16. Since a portion on which the tab 15 abuts is borne by no support, the elastic tongue 17 may be deflected excessively over the elastic limit when the tab 15 strongly pushes down the tongue 17 at the intermediate portion.

In order to overcome the above problem, it may be possible to enhance a bending strength of a section between the turned-back portion 17*a* of the elastic tongue 17 and the contact area 17*b* with the stoppers 13 by extending the stoppers 13 to the front end so as to shorten a distance between the turned-back portion 17*a* and the stoppers 13.

However, since the stoppers 13 are provided on the longitudinal side edges of the fitting aperture 12, it is impossible to extend the stoppers 13 over an engaging front edge 12*a* of the fitting aperture 12, which engages with the lance. Thus, there is a certain restriction in shortening the distance between the stoppers 13 and the turned-back portion 17*a* of the elastic tongue 17.

SUMMARY OF THE INVENTION

An object of the present invention is to provide a female terminal metal fixture in which a portion between a turned-back portion and a portion supported by stoppers on an elastic tongue can be prevented from being extremely deflected when the portion therebetween is strongly pushed down by a tab of a male terminal metal fixture.

A female terminal metal fixture in accordance with the present invention comprises an insulation barrel, a wire barrel and a box-like terminal body, which are formed together by bending a thin metal plate with a given shape. The insulation barrel is adapted to be crimped on a sheath of an electrical cable. The wire barrel is adapted to be crimped on core wires of the electrical cable. The box-like terminal body includes an insulation space into which a tab of a male terminal metal fixture is inserted through a front opening in the body, a turned-back portion in the front opening, an elastic tongue which extends from the turned-back portion into the insertion space so as to resiliently contact with the tab, and a pair of stoppers which support the elastic tongue against an excess deflection of the elastic tongue. The elastic tongue is provided on a contact side with the tab with a reinforced portion which is formed by a bulging process so as to extend from the turned-back portion to a portion supported by the stoppers. The reinforced portion is provided on the contact side with the tab with a longitudinal ramp face which increases a height gradually from the front opening to a contact area on the contact side with the tab.

The stopper may be formed by upwardly bending a part of a bottom wall of the box-like terminal body, by downwardly bending parts of opposite longitudinal side edges of the elastic tongue, or by horizontally projecting parts of opposed side walls of the box-like terminal body.

The stoppers may be faced to the elastic tongue so that the stoppers can engage with and disengage from the elastic tongue at a rear side opposite to the contact side with the tab. The stopper may be provided on the top portion with an engaging face which conforms to a shape of the elastic tongue.

A width of the reinforced portion on said elastic tongue may be gradually widened or narrowed or uniformed from the turned-back portion to the contact area.

The box-like body may be provided between the turned-back portion and the stoppers in the interior thereof with an auxiliary stopper which supports the elastic tongue against an excess deflection.

The stoppers and auxiliary stopper may be formed by upwardly bending a part of a bottom wall of said box-like terminal body, by downwardly bending parts of opposite longitudinal side edges of the elastic tongue, or by horizontally projecting parts of opposed side walls of the box-like terminal body.

In the present invention, since the reinforced portion is formed between the turned-back portion and the contact area with the stoppers on the elastic tongue, the reinforced portion can enhance a bending strength of the tongue, thereby preventing bending deformation upon strong abutment of the tab.

When the tab enters the insertion space in the box-like terminal body, at first, the tab contacts with a lower part of the reinforced portion, then advances to an upper part of the portion, and finally reaches the top contact area. A contacting pressure between the tab and the reinforced portion during this contact process is low at commencement of insertion, becomes gradually higher as the insertion progresses and becomes maximum at the top area.

The elastic tongue is borne on the stoppers at the distal end side and on the auxiliary stopper at the proximal end side when the tongue is excessively deflected, thereby distributing the excess bending force at two sections.

The elastic tongue is borne by the stoppers in a manner of a plane contact.

According to the present invention, it is possible to prevent the elastic tongue from being excessively deflected over the elastic limit even if a strong pushing force is applied to the section between the turned-back portion of the tongue and the support area with the stoppers by the tab, since the elastic tongue is enhanced against a bending force by means of the reinforced portion extending from the turned-back portion to the support area. Further, since the tab moves on the reinforced portion from the lower part to the upper part as the tab advances in the terminal body, an insertion resistance is low at the initial insertion of the tab and this results in an efficient and easy insertion work.

It is possible to prevent the elastic tongue from being excessively deflected over the elastic limit by the strong pushing force from the tab, the elastic tongue is supported on the stoppers and auxiliary stopper.

In addition, it is possible to prevent excess deflection of the elastic tongue over the elastic limit even if the elastic tongue is clamped between the stopper and the tab, since the elastic tongue is supported by the stoppers in a manner of the plane contact.

DETAILED DESCRIPTION OF THE PREFERRED EMBODIMENTS

By referring now to FIGS. 1 to 13, first to tenth embodiments of a female terminal metal fixture in accordance with the present invention will be explained below.

<Embodiment 1>

A first embodiment carrying out a basic construction of the present invention will be described below by referring to FIGS. 1 to 4A and FIGS. 7A to 7C.

Figure 1:
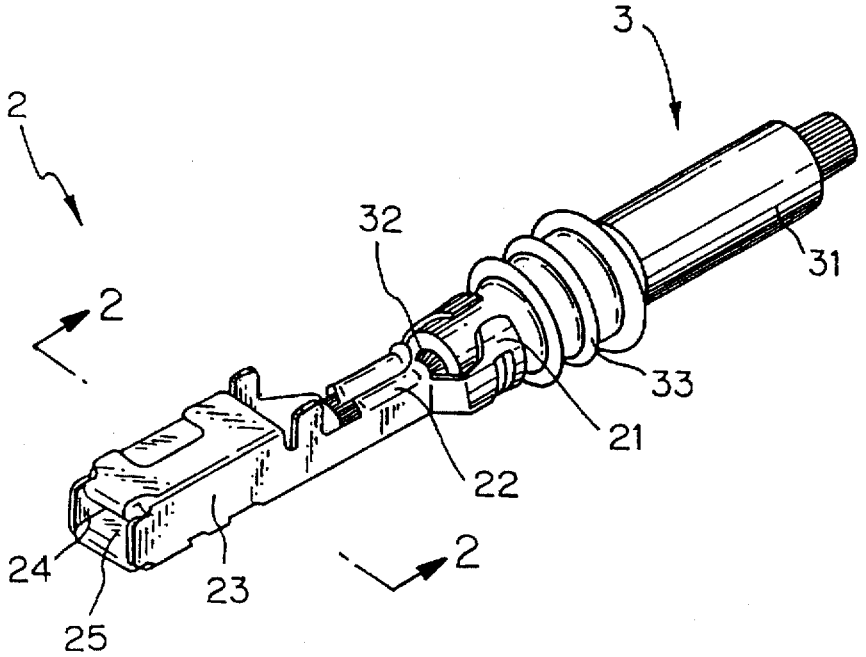
FIG. 1 is a schematic perspective view of an embodiment of a female terminal metal fixture in accordance with the present invention.
Figure 2:
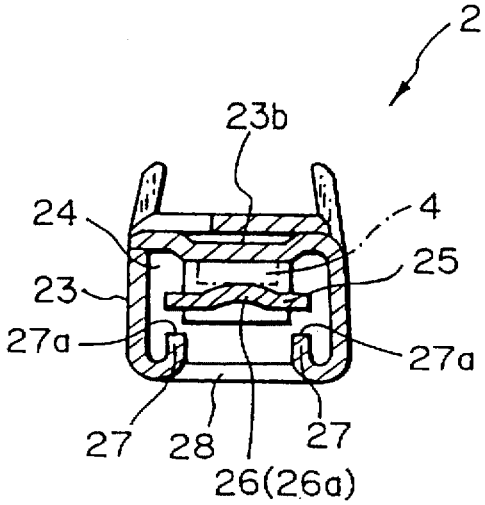
FIG. 2 is a cross sectional view taken along line 2—2 in FIG. 1, illustrating a position in which a tab of a male terminal metal fixture is properly inserted into the female terminal metal fixture.
Figure 3A:
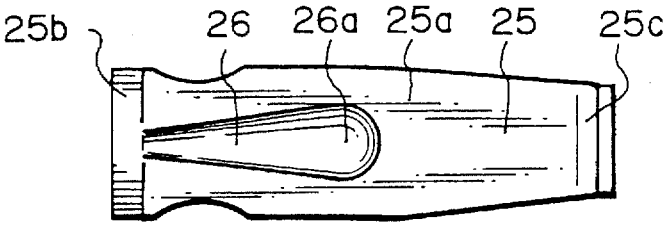
FIGS. 3A to 3C are plan views of various types of reinforced portions on an elastic tongue.
Figure 3B:
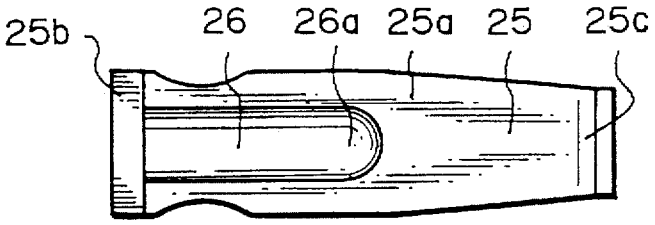
Figure 3C:
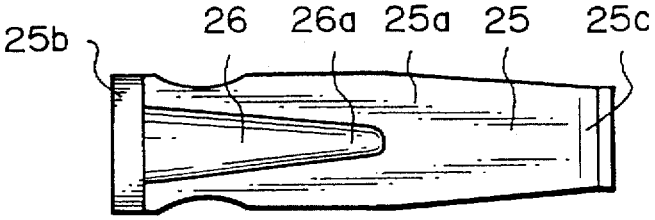

A female terminal metal fixture 2 of the present embodiment comprises an insulation barrel 21, a wire barrel 22 and a box-like terminal body 23, which are formed together by bending a thin metal plate with a given shape. As shown in FIG. 1, the insulation barrel 21 is adapted to be crimped on a sheath 31 of an electrical cable 3 together with a waterproofing plug 33. The wire barrel 22 is adapted to be crimped on core wires 32 of the electrical cable 3.

The box-like terminal body 23 includes an insertion space 24 into which a tab 4 of a male terminal metal fixture (not shown) is inserted through a front opening in the body 23, a turned-back portion **25*b* in the front opening, an elastic tongue 25 which extends from the turned-back portion 25*b* into the insertion space 24 so as to resiliently contact with the tab 4. The elastic tongue 25 is formed into a gently bent body which has a top area 25*a***.

The elastic tongue 25 is provided on opposite side edges near the turned-back portion **25*b* with archwise recesses, respectively. The width of the elastic tongue 25 becomes narrow gradually from the archwise recesses to a distal end 25*c***, thereby avoiding a stress concentration in the elastic tongue.

The elastic tongue 25 is provided with a reinforced portion 26 which can prevent an excess deflection of the tongue over its elastic limit. The reinforced portion is bulged on an upper face (contact face with the tab 4) within a section from the turned-back portion 25*b* to the top area 25*a*.

Figure 4A:
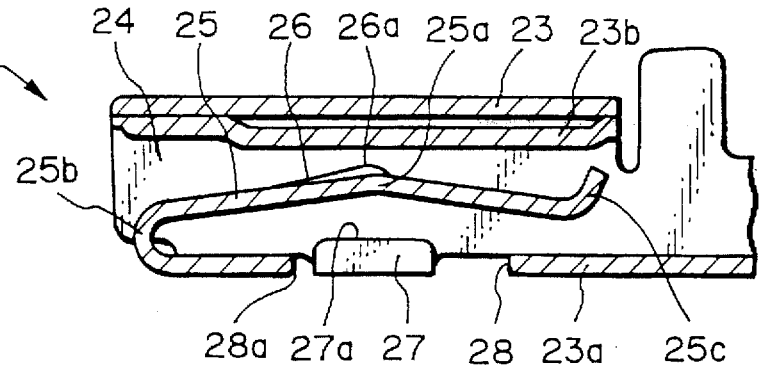
FIGS. 4A to 4D are partial longitudinal sectional views of first to fourth embodiments of the female terminal metal fixture in accordance with the present invention.

The width of the reinforced portion 26 may become wide (FIG. 3A) or narrow (FIG. 3C) gradually, or uniform from a side of the turned-back portion 25*b* to a side of a contact area 26*a* described below. The height of the reinforced portion 26, as shown in FIG. 4A, is equal to the upper face of the elastic tongue 25 near the turned-back portion 25 and gradually increases to the top area 25*a*. The height is maximum at the top area 25*a*, which becomes a contact area 26*a* with the tab 4 upon completion of insertion.

Thus, the reinforced portion 26 can enhance a bending strength over a section between the turned-back portion 25*b* and the top area 25*a* of the elastic tongue 25.

The box-like terminal body 23 is provided on a bottom wall 23*a* with a pair of stoppers 27, 27, which prevent an excess deflection of the elastic tongue 25 in cooperation with the reinforced portion 26. The stopper 27 stands on each longitudinal side edge of a fitting aperture 28 which receives a lance (not shown) in a connector (not shown). The stoppers are faced to a rear side of the top area 25*a* on the elastic tongue 25.

The stopper 27 is provided on its top with a contact face 27*a* which bears the rear side of the elastic tongue 25. That is, the contact faces 27*a* bear the rear side of the top area 25*a* when the elastic tongue 25 is deflected to a lower position (FIG. 7C) than a regular position (FIG. 7B) described below.

Figure 7A:
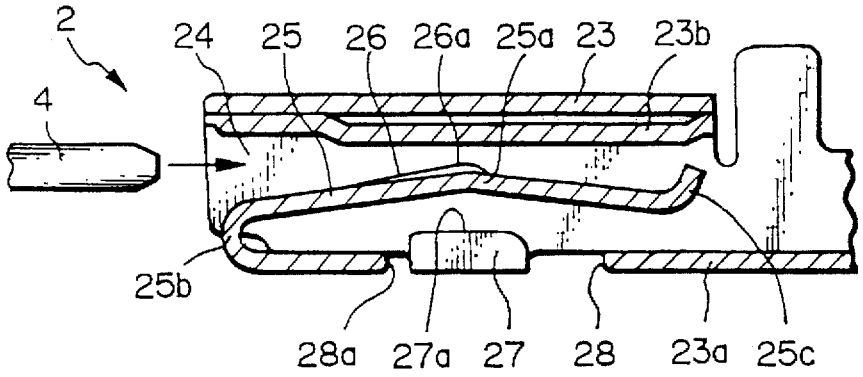
FIGS. 7A to 7C are partial longitudinal sectional views of a first embodiment of the female terminal metal fixture in accordance with the present invention, illustrating an operation of the embodiment.

Next, an operation of the present embodiment will be explained below by referring to FIGS. 7A to 7C.

When the tab 4 is inserted along a ceiling wall 23*b* of the terminal body 23 into the insertion space 24 in a proper direction (FIGS. 7A and 7B), the tab 4 contacts with the reinforced portion 26 and pushes down the elastic tongue 25 gradually as the tab 4 advances in the body 23. Then, the elastic tongue 25 turns down around the turned-back portion 25*b* and is slightly widened at the top portion 25*a* when the distal end 25*c* contacts with the bottom wall 23*a*. As shown in FIG. 7B, the tab 4 is resiliently clamped between the ceiling wall 23*b* and the contact area 26*a* on the reinforced portion 26 by means of an elastic recovery force, thereby electrically conducting the tab 4 and the elastic tongue 25.

Figure 7B:
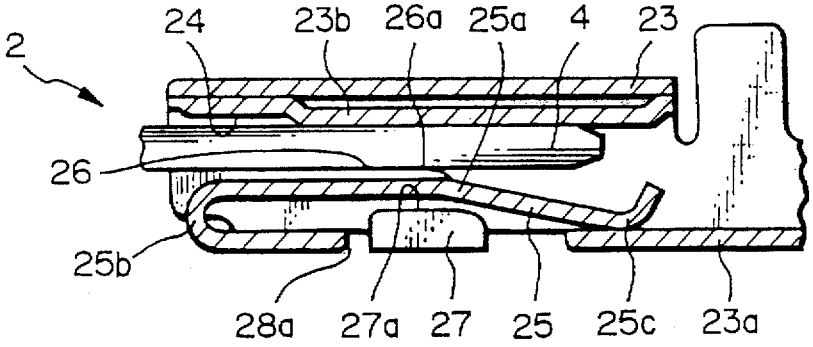

During the inserting process of the tab 4, it first contacts with the lower part of the reinforced portion 26 on the elastic tongue 25, then moves on the reinforced portion 26 toward the upper part, and reaches the highest contact area 26*a* shown in FIG. 7B upon the completion of insertion. During this process, the contacting pressure between the tab 4 and the reinforced portion 26 is lowest at the initiation of insertion, becomes higher gradually as the tab 4 advances in the terminal body 23, and is highest at the completion of the insertion when the tab 4 contacts with the contact area 26*a*. Accordingly, the inserting resistance becomes low at the initial insertion and thus a fitting work of the female terminal metal fixture 2 and male terminal metal fixture become easy and efficient. Also, the contacting pressure between the tab 4 and the elastic tongue 25 becomes high sufficiently upon the completion of insertion. Moreover, since the height of the reinforced portion 26 increases gradually from the upper face near the turned-back portion 25*b* of the elastic tongue 25 to the contact area 26*a*, the tab 4 does not strike or stick the reinforced portion 26 and smoothly enters the insertion space 24 from the commencement of insertion to the completion of insertion.

Figure 7C:
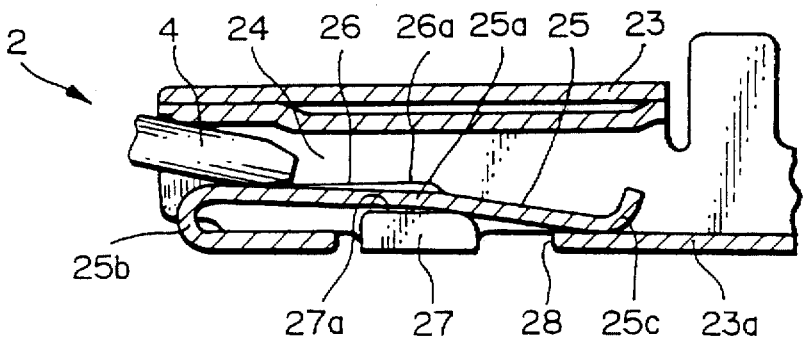

On the contrary, when the tab 4 is inserted slantly down, the distal end of the tab 4 pushes down a section between the turned-back portion 25*b* of the elastic tongue 25 and the top area 25*a* as shown in FIG. 7C, thereby deflecting the elastic tongue 25 to a lower position than a regular position where the tab 4 is properly inserted. At this time, the elastic tongue 25 is borne on the contact faces 27*a* on the stoppers 27. This abutment on the stoppers 27 prevents the elastic tongue 25 from being deflected down around the turned portion 25*b*.

<Embodiment 2>

Figure 4B:
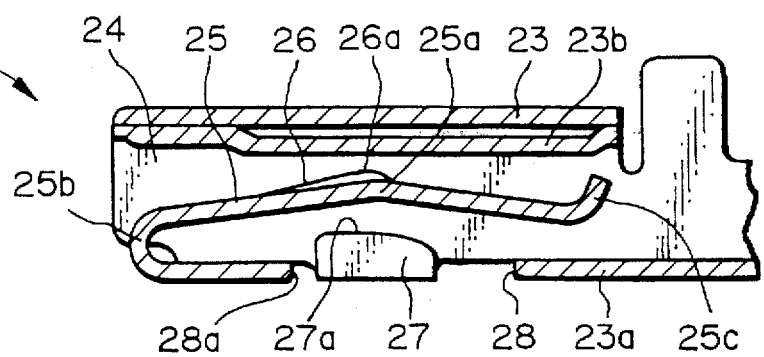

AS shown in FIG. 4B, stoppers 27 in this embodiment are faced to an elastic tongue 25 so that the stoppers 27 can engage with and disengage from the elastic tongue 25 at a rear side opposite to the contact side with a tab 4. The stopper 27 is provided on the top portion with an contact face 27*a* which conforms to a shape of the elastic tongue 25.

Figure 8A:
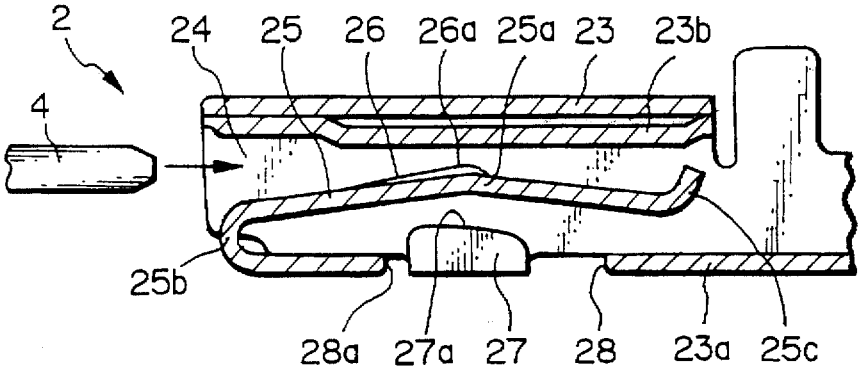
FIGS. 8A to 8C are partial longitudinal sectional views of a second embodiment of the female terminal metal fixture in accordance with the present invention, illustrating an operation of the embodiment.
Figure 8B:
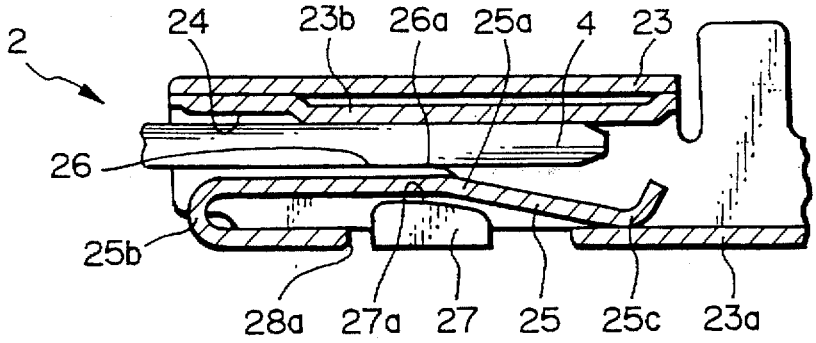
Figure 8C:
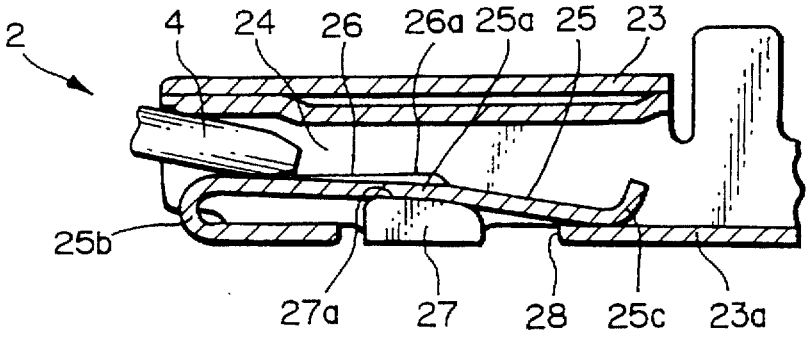

Since the other structures of this embodiment are the same as those of the first embodiment, explanations of them are omitted here. An operation of this embodiment is shown in FIGS. 8A to 8C.

In this embodiment, since the contact face 27*a* on the top portion of each stopper 27 contacts with the rear side opposite to the contact area 25*a* on the elastic tongue 25, even if the elastic tongue 25 is strongly clamped between the tab 4 and the stoppers 27, the elastic tongue 25 is not deformed by a clamping force. In the case that any clearance exists between the elastic tongue 25 and the stoppers 27, the elastic tongue 25 is deformed by the clamping force. Accordingly, the elastic tongue 25 is prevented from being deflected excessively over an elastic limit of the elastic tongue 25 within a contact area between the stoppers 27 and the tongue (FIG. 8C).

<Embodiment 3>

Figure 4C:
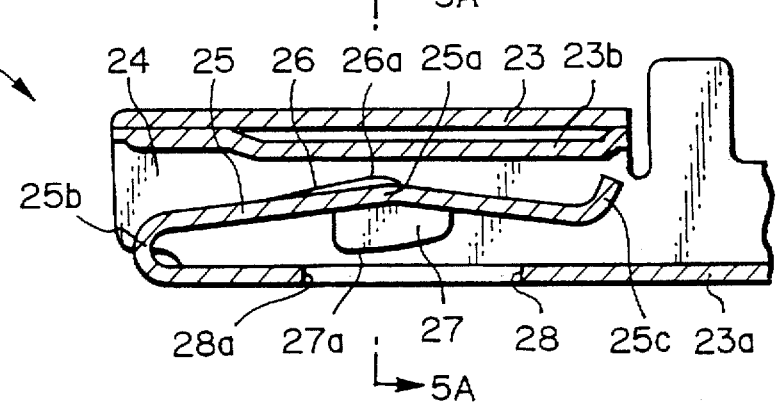
Figure 5A:
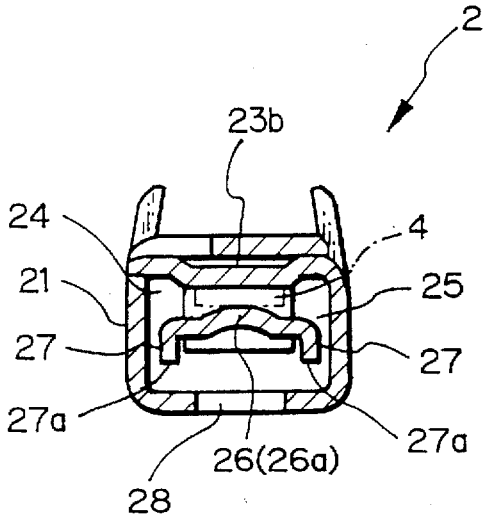
FIG. 5A is a cross sectional view of a third embodiment taken along line 5A—5A in FIG. 4C.

Stoppers 27 in this embodiment, as shown in FIGS. 4C and 5A are formed by downwardly bending parts of opposite longitudinal side edges of an elastic tongue 25.

Since the other structures and operation of this embodiment are the same as those of the first embodiment, explanations of them are omitted here.

<Embodiment 4>

Figure 4D:
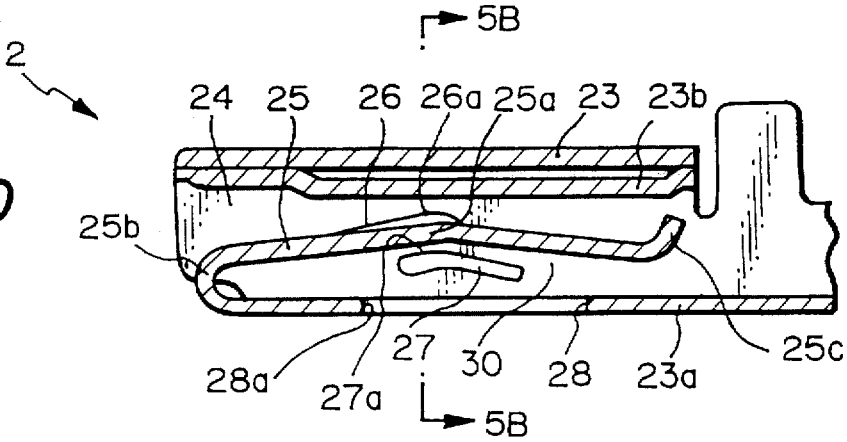
Figure 5B:
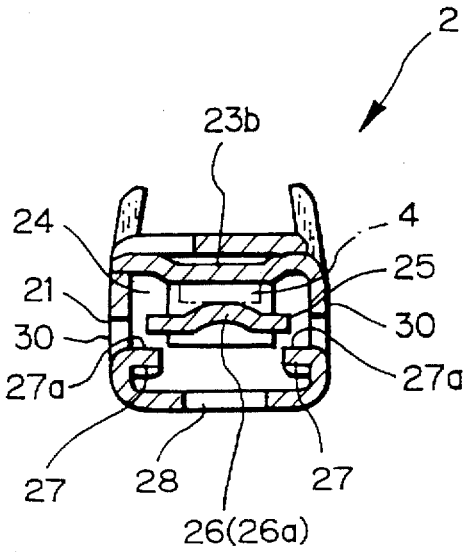
FIG. 5B is a cross sectional view of a fourth embodiment taken along line 5B—5B in FIG. 4D.

Stoppers 27 in this embodiment, as shown in FIGS. 4D and 5B are formed by horizontally projecting parts of opposed side walls 30 of a box-like terminal body 23.

Since the other structures and operation of this embodiment are the same as those of the first embodiment, explanations of them are omitted here.

<Embodiment 5>

Figure 6A:
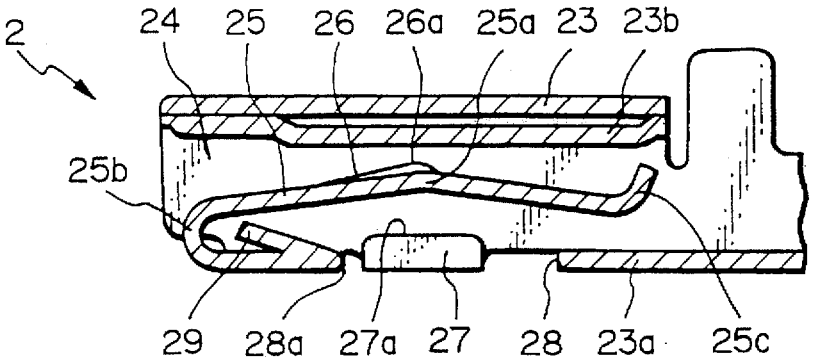
FIGS. 6A to 6F are partial longitudinal sectional views of fifth to tenth embodiments of the female terminal metal fixture in accordance with the present invention.

In this embodiment shown in FIG. 6A, in addition to the structures of the first embodiment, the terminal body 23 is provided between the turned-back portion 25*b* of the elastic tongue 25 and the stoppers 27 with auxiliary stopper 29 which prevents the excess deflection of the tongue in cooperation with the reinforced portion 26 and stoppers 27. The auxiliary stopper 29 extends slantly upwardly from the front engaging edge 28*a* in the fitting aperture 28 which receives a lance (not shown). The auxiliary stopper is disposed near the turned-back portion 25*b* between the turned-back portion 25*b* and the top area 25*a* so as to contact with the rear side of the elastic tongue 25. Since the auxiliary stopper 29 is shorter than the elastic tongue 25, the auxiliary stopper 29 is hardly deflected by a pushing force from the tongue 25.

Also, since the elastic tongue 25 is borne on the auxiliary stopper 29 near the turned-back portion 25*b*, the portion 25*b* is not collapsed. Further, since a section between the turned-back portion 25*b* and the top area 25*a* is borne on the auxiliary stopper 29 and is provided with the reinforced portion 26 so as to enhance the bending strength of the elastic tongue 25, the elastic tongue 25 is hardly deformed down between the turned-back portion 25*b* and the top area 25*a*.

It is possible to positively prevent the excess deflection of the elastic tongue 25 over its elastic limit even if a strong pushing force by the tab 4 is applied to any position between the turned-back portion 25*b* and the top area 25*a*, since the elastic tongue 25 is borne on the stoppers 27 and auxiliary stopper 29 and the reinforced portion 26 enhances a bending stiffness.

Since the other structures and operation of this embodiment are the same as those of the first embodiment, explanations of them are omitted here.

<Embodiment 6>

Figure 6B:
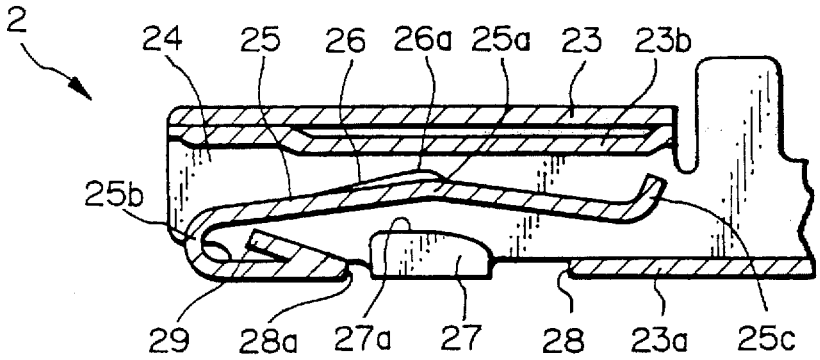

In this embodiment shown in FIG. 6B, in addition to the structures of the first embodiment, the stoppers 27 are faced to the elastic tongue so that the stoppers 27 can engage with and disengage from said elastic tongue at a rear side opposite to the contact side with the tab 4. Each stopper 27 is provided on the top area with a contact face 27*a* which conforms to a shape of the elastic tongue 25.

Figure 9A:
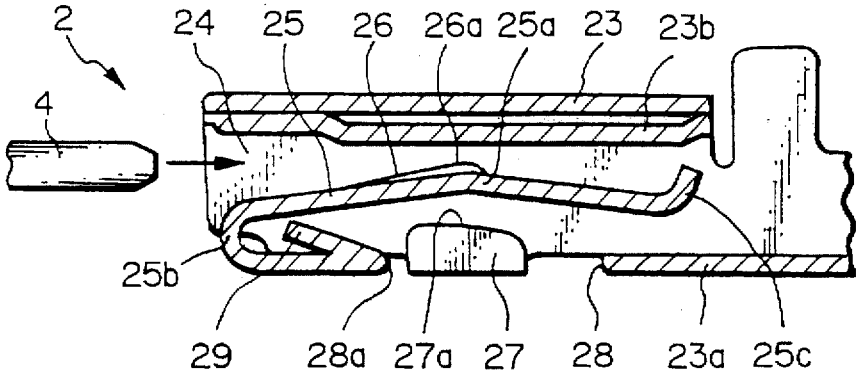
FIGS. 9A to 9C are partial longitudinal sectional views of sixth embodiment of the female terminal metal fixture in accordance with the present invention, illustrating an operation of the embodiment.
Figure 9B:
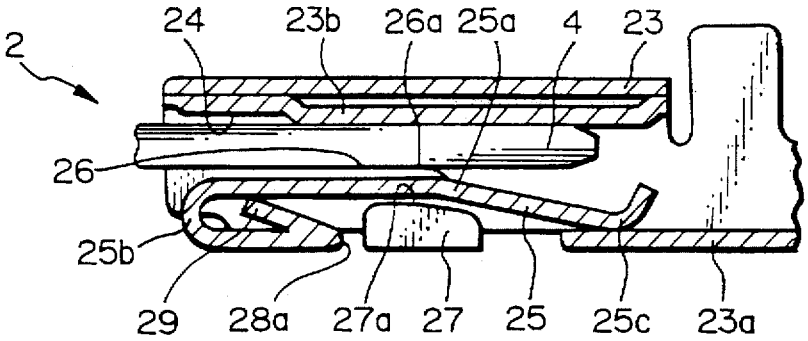
Figure 9C:
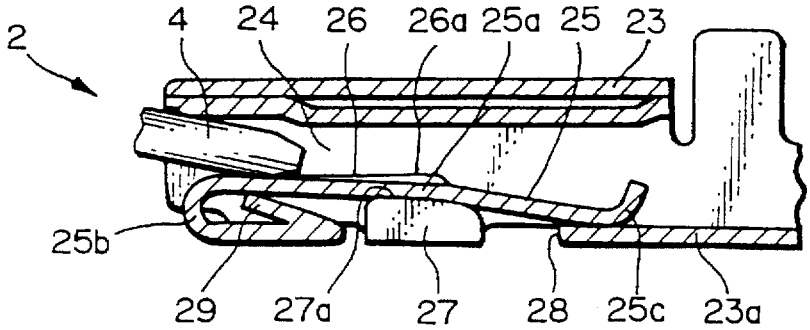

Since the other structure of this embodiment are the same as those of the first embodiment, explanations of them are omitted here. An operation of this embodiment is shown in FIGS. 9A to 9C.

In the present embodiment, since the contact faces 27*a* on the stoppers 27 bear the rear sides of the top area 25*a* on the elastic tongue 25 in a manner of the plane contact, the elastic tongue 25 is not deformed by the clamping force even if the tongue 25 is strongly clamped between the tab 4 and the stopper 27. In the case that a gap between the elastic tongue 25 and the stoppers exists, the elastic tongue 25 is deformed by the clamping force. Accordingly, it is possible to prevent the elastic tongue from being deflected excessively over its elastic limit within a contacting section with the stoppers 27.

<Embodiment 7>

Figure 6C:
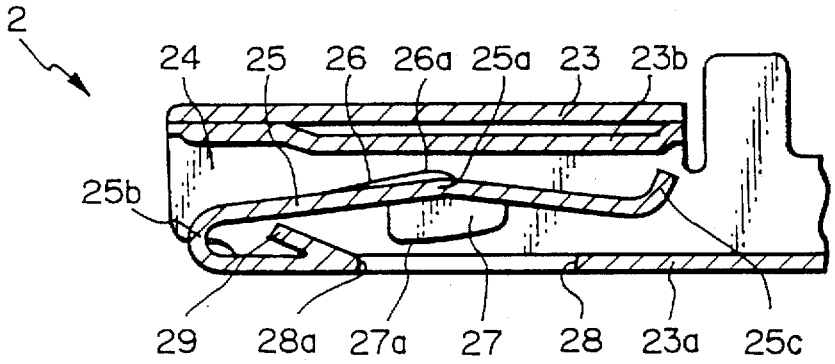

Stoppers 27 in this embodiment, as shown in FIGS. 6C and 5A, are formed by downwardly bending parts of opposite longitudinal side edges of an elastic tongue 25.

Figure 10A:
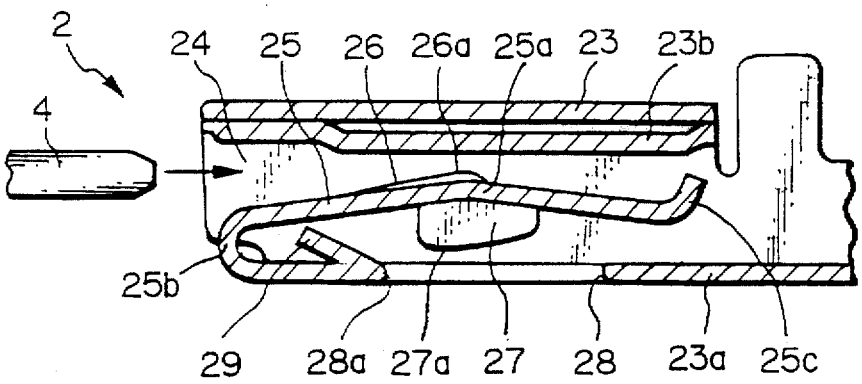
FIGS. 10A to 10C are partial longitudinal sectional views of a seventh embodiment of the female terminal metal fixture in accordance with the present invention, illustrating an operation of the embodiment.
Figure 10B:
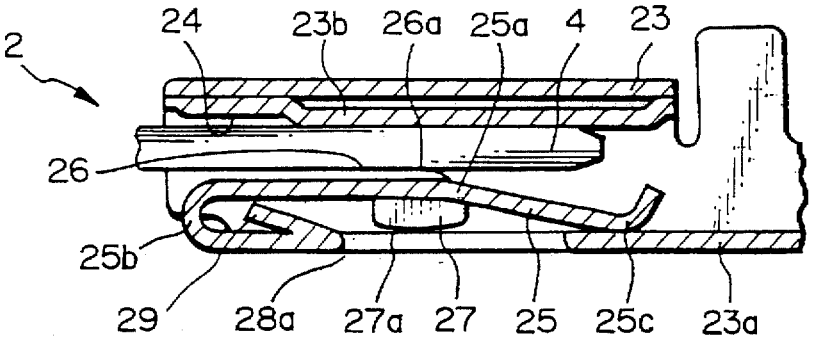
Figure 10C:
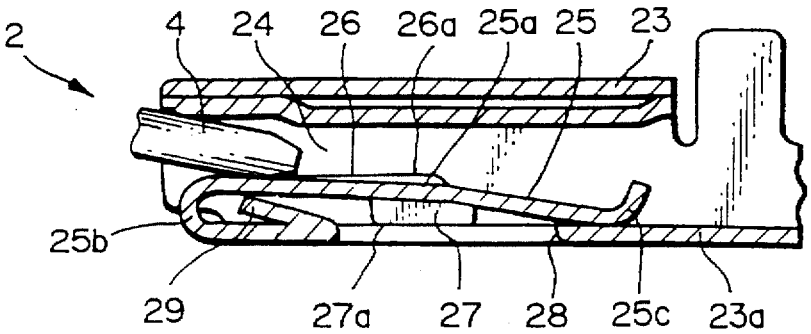

Since the other structure of this embodiment are the same as those of the first embodiment, explanation of them are omitted here. An operation of this embodiment is shown in FIGS. 10A to 10C.

<Embodiment 8>

Figure 6D:
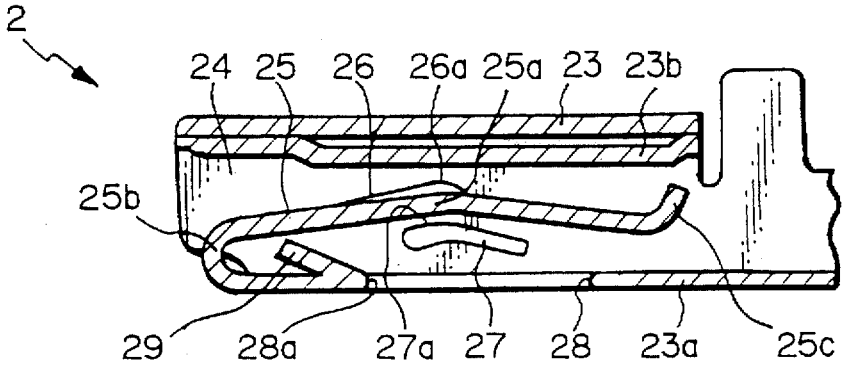

Stoppers 27 in this embodiment, as shown in FIGS. 6D and 5B, are formed by horizontally projecting parts of opposed side walls 30 of a box-like terminal body 23.

Figure 11A:
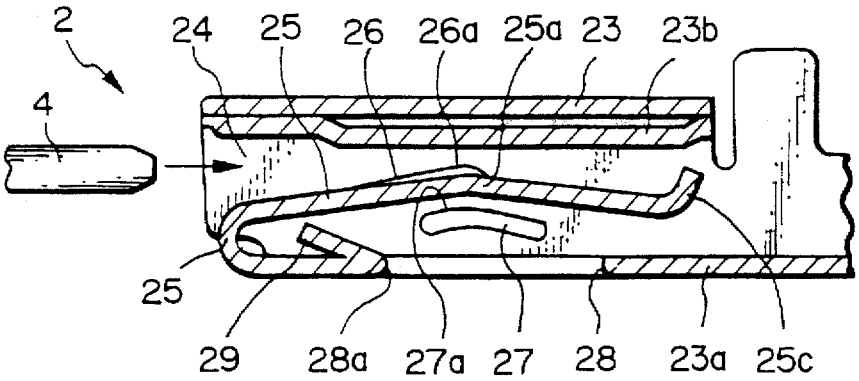
FIGS. 11A to 11C are partial longitudinal sectional views of an eighth embodiment of the female terminal metal fixture in accordance with the present invention, illustrating an operation of the embodiment.
Figure 11B:
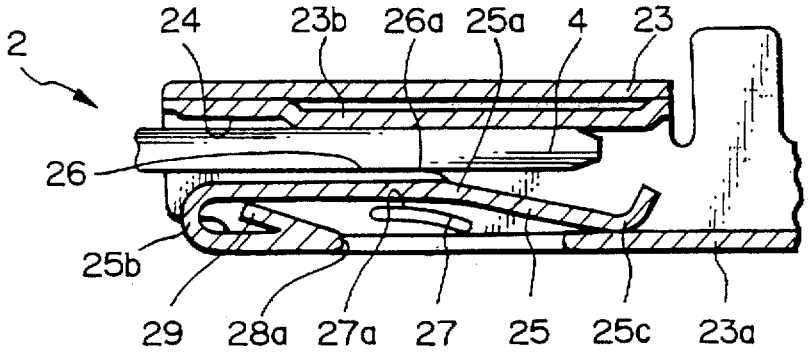
Figure 11C:
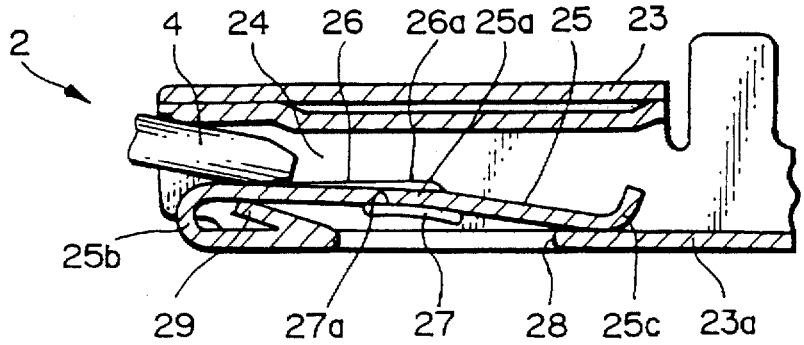

Since the other structures and operation of this embodiment are the same as those of the first embodiment, explanations of them are omitted here. An operation of this embodiment is shown in FIGS. 11A to 11C.

<Embodiment 9>

Figure 6E:
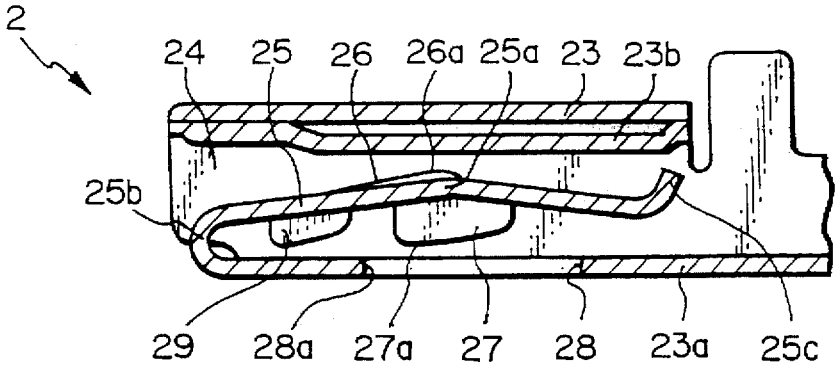

Stoppers 27 and auxiliary stoppers 29 in this embodiment, as shown in FIGS. 6E and 5A, are formed by downwardly bending parts of opposite longitudinal side edges of an elastic tongue 25.

Figure 12A:
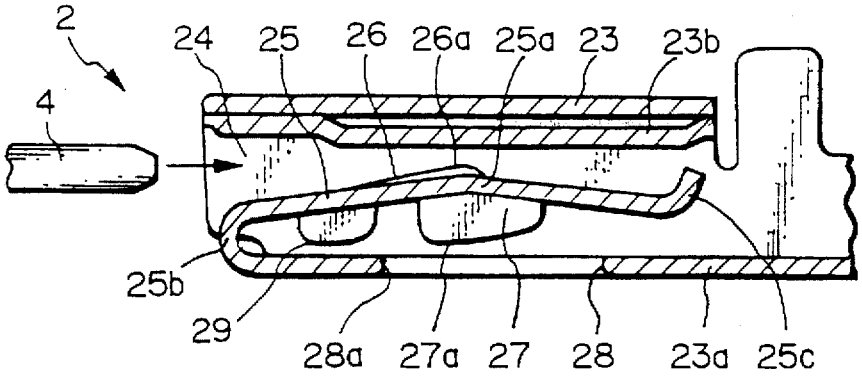
FIGS. 12A to 12C are partial longitudinal sectional views of a ninth embodiment of the female terminal metal fixture in accordance with the present invention, illustrating an operation of the embodiment.
Figure 12B:
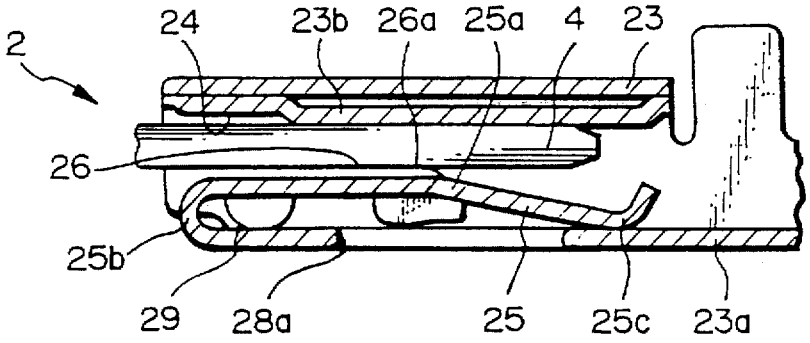
Figure 12C:
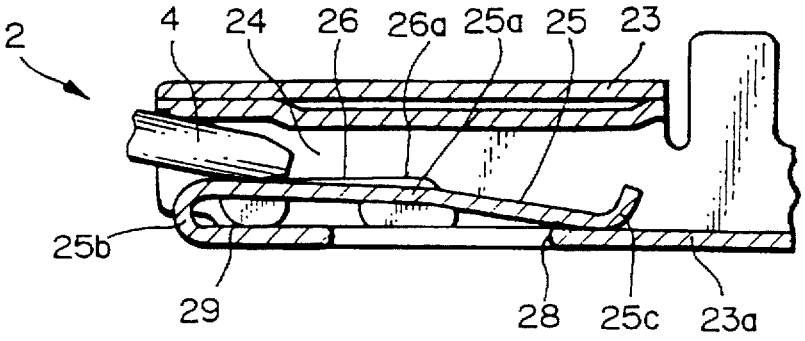

Since the other structures and operation of this embodiment are the same as those of the first embodiment, explanations of them are omitted here. An operation of this embodiment is shown in FIGS. 12A to 12C.

<Embodiment 10>

Figure 6F:
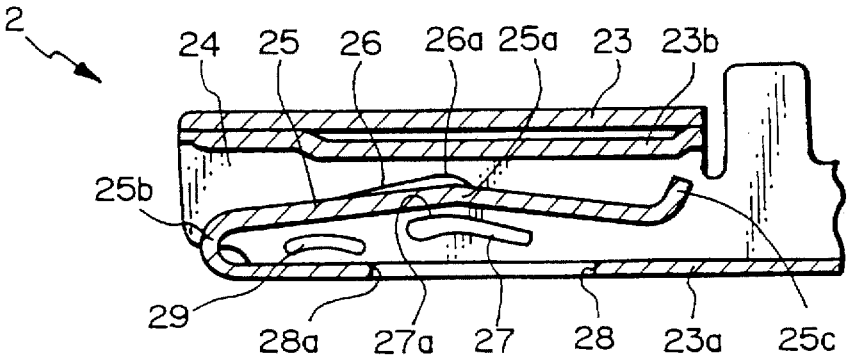

Stoppers 27 and auxiliary stoppers 29 in this embodiment, as shown in FIGS. 6F and 5B, are formed by horizontally projecting parts of opposed side walls 30 of a box-like terminal body 23.

Figure 13A:
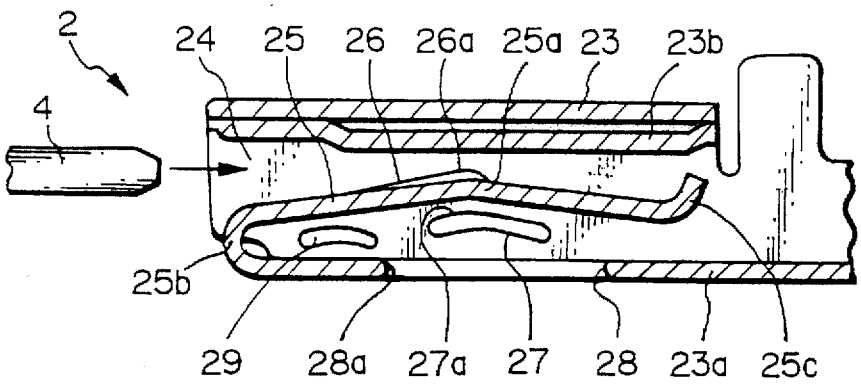
FIGS. 13A to 13C are partial longitudinal sectional views of a tenth embodiment of the female terminal metal fixture in accordance with the present invention, illustrating an operation of the embodiment.
Figure 13B:
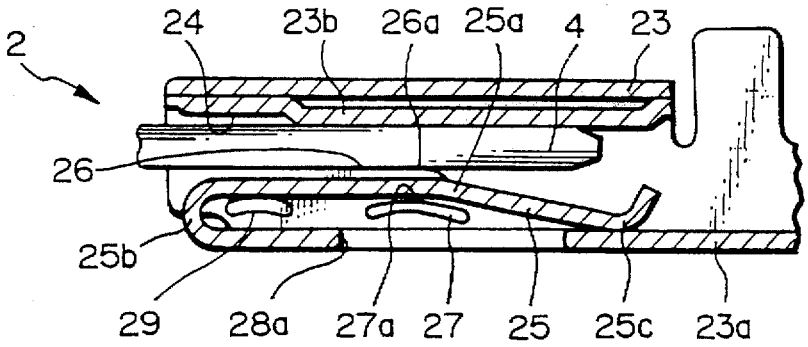
Figure 13C:
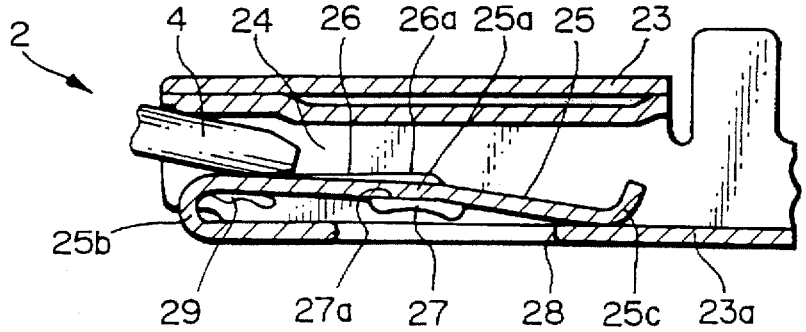
Figure 14:
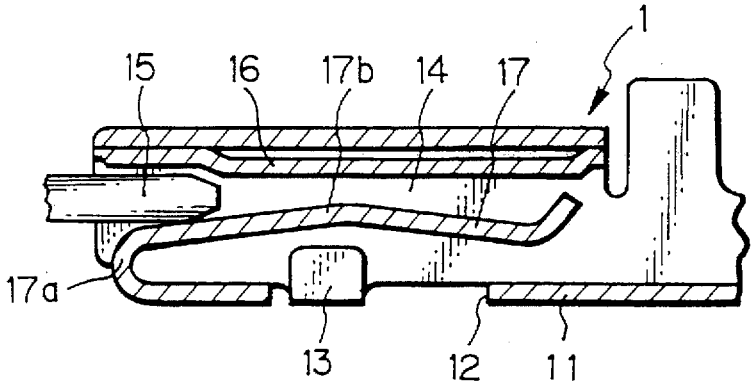
Fig. 14 PRIOR ART
FIG. 14 is a longitudinal sectional view of a conventional female terminal metal fixture, illustrating a position in which a tab of a male terminal metal fixture commences to enter into the female terminal metal fixture.
Figure 15:
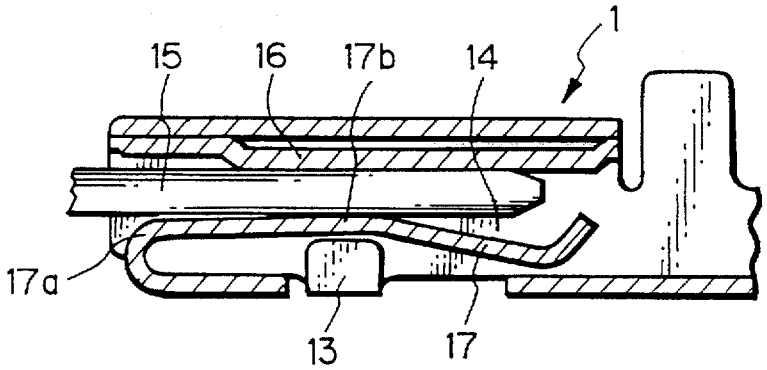
Fig. 15 PRIOR ART
FIG. 15 is a longitudinal sectional view of a conventional female terminal metal fixture, illustrating a position in which the tab is properly inserted into the female terminal metal fixture.
Figure 16:
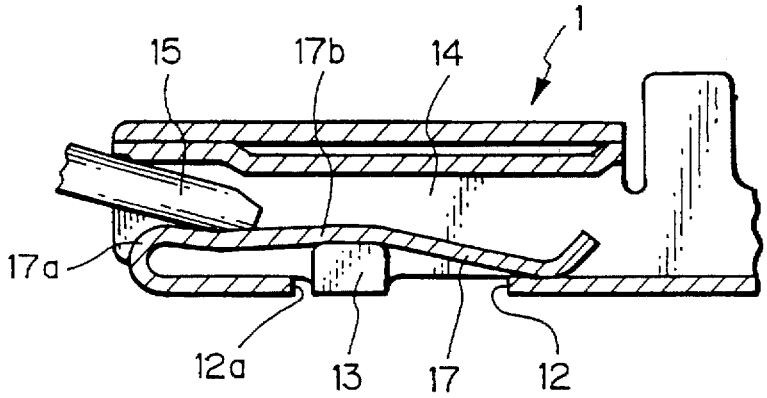
Fig. 16 PRIOR ART
FIG. 16 is a longitudinal sectional view of a conventional female terminal metal fixture, illustrating a position in which the tab is improperly inserted into the female terminal metal fixture, thereby causing an excess deflection of an elastic tongue.

Since the other structures and operation of this embodiment are the same as those of the first embodiment, explanations of them are omitted here. An operation of this embodiment is shown in FIGS. 13A to 13C.

What is claimed is:

1. A female terminal fixture comprising an insulation barrel, a wire barrel, and a box-like terminal body, said insulation barrel adapted to be crimped on a sheath of an electrical cable, said wire barrel adapted to be crimped on core wires of said electrical cable, said terminal body including an insertion space into which a tab of a male terminal fixture is inserted through a front opening in said body, a turned-back portion in said front opening, an elastic tongue which extends from said turned-back portion into said insertion space so as to resiliently contact said tab, and a pair of stoppers which support said elastic tongue against an excess deflection of said elastic tongue, a support portion comprising a lower portion and said tongue, said lower portion extending along a floor of said body from said turned-back portion toward said stoppers and terminating in a lower distal end, said tongue spaced apart from said floor, extending from said turned-back portion toward said stoppers, and terminating in an upper distal end, said upper distal end being farther from said turned-back portion than said lower distal end, an auxiliary stopper extending from said lower distal end toward said turned-back portion and adapted to support said tongue in cases of excessive deflection thereof, said elastic tongue being provided on a contact side with a reinforced portion which extends from said turned-back portion to a portion supported by said stoppers, said reinforced portion including a longitudinal ramp face which increases in height gradually from said front opening to a contact area.

2. A female terminal metal fixture according to claim 1, wherein said stoppers and auxiliary stoppers are formed by upwardly bending parts of a bottom wall of said box-like terminal body.

3. A female terminal metal fixture according to claim 1, wherein said stoppers and auxiliary stoppers are formed by downwardly bending parts of opposite longitudinal sides edges of said elastic tongue.

4. A female terminal metal fixture according to claim 1, wherein said stoppers and auxiliary stoppers are formed by horizontally projecting parts of opposed side walls of said box-like body.

5. A female terminal metal fixture according to claim 1, wherein said stoppers are faced to said elastic tongue so that said stoppers can engage with and disengage from said elastic tongue at a rear side opposite to said contact side with said tab, and wherein said each stopper is provided on the top portion with an engaging face which conforms to a shape of said elastic tongue.

6. A female terminal metal fixture according to claim 1, wherein a width of said reinforced portion on said elastic tongue is gradually widened or narrowed or uniformed from said turned-back portion to said contact area.

* * * * *